United States Patent [19]

Fowler

[11] Patent Number: 5,046,436

[45] Date of Patent: Sep. 10, 1991

[54] APPARATUS AND METHOD FOR THE PREHEATING OF LIQUID WASTES IN A WASTE DISPOSAL PROCESS

[76] Inventor: Benjamin P. Fowler, 805 S. Country Club Dr., LaPorte, Tex. 77057

[21] Appl. No.: 598,848

[22] Filed: Oct. 15, 1990

[51] Int. Cl.[5] ..... F23B 7/00

[52] U.S. Cl. ..... 110/349; 48/197 A; 110/229; 110/238; 110/346; 122/31.1; 122/32

[58] Field of Search ..... 110/229, 238, 346, 349; 48/197 R, 197 A, 65, 111, 202; 122/32, 31.1; 261/158

[56] References Cited

U.S. PATENT DOCUMENTS

| | | | |
|---|---|---|---|
| 2,276,780 | 3/1942 | Johannson | 122/412 X |
| 4,222,350 | 9/1980 | Pompei et al. | 122/32 |
| 4,460,328 | 7/1984 | Niederholtmeyer | 110/238 X |

*Primary Examiner*—Edward G. Favors

*Attorney, Agent, or Firm*—Harrison & Egbert

[57] ABSTRACT

An apparatus for the preheating of liquid waste having a heated sealed container, a liquid waste tank, a jacket positioned around the sealed container so as to form a heat exchange region between the interior of the jacket and the exterior of the sealed container, and an injector for transmitting a heated liquid waste from the tank into the interior of the sealed container. An inert gas container is connected to the waste tank so as to pass argon gas for displacing the oxygen from the interior of the liquid waste tank. An insulating layer is formed around the exterior of the sealed container and the waste tank. Suitable conduits connect the waste tank with the heat exchange region of the sealed container. A storage vessel is in valved relationship with the liquid waste tank. Suitable pumping is provided so as to transmit the liquid waste into the heat exchange region and back to the liquid waste tank.

19 Claims, 2 Drawing Sheets

APPARATUS AND METHOD FOR THE PREHEATING OF LIQUID WASTES IN A WASTE DISPOSAL PROCESS

TECHNICAL FIELD

The present invention relates to apparatus and methods for the disposal of waste. More particularly, the present invention relates to those apparatus and methods in which a liquid waste is preheated prior to being gasified. Additionally, the present invention relates to apparatus and methods for waste disposal that gasify waste in an oxygen-free environment.

BACKGROUND ART

Garbage and waste are produced in communities in great quantities. This garbage and waste must be disposed of in a variety of ways. The disposal of various kinds of garbage and waste in large quantities in cities is one of the important new administrative problems facing city government. Typical methods for the disposal of garbage include discharging garbage into the sea for reclamation and burying garbage underground. However, there are great problems, such as pollution of sea water and difficulty in getting land associated with these methods. The general trend at present is directed toward the disposal of garbage by complete incineration. However, and unfortunately, the prevailing technique for the disposal of garbage by incineration, a method is used which burns garbage on fire grates with large quantities of air supplied, thus creating a number of associated problems.

It has been found that the use of large quantities of air produces large quantities of exhaust gases, thereby creating and exacerbating air pollution. Since the combustion temperature of garbage is relatively low, the residue of burnt garbage cannot be made completely harmless. A great deal of environmental pollution is caused by such effluents from this incineration process. Since the combustion of garbage on fire grates is unstable, the efficiency of heat recovery is low and it is difficult to effectively use the heat generated by the combustion and garbage. Additionally, vast space is occupied by the fire grates. This requires a large area for the combustion site. Furthermore, there is a difficulty in getting the sites for the construction of large incinerating plants because of the environmental problems associated therewith.

Recently, disposal methods have been proposed which attempt to solve some of the problems associated with thermal decomposition. Essentially, the garbage is introduced into an incinerator with the heat necessary for thermal decomposition so as to produce a generated slag and gas. There are two processes that are available—a process which uses external heat as an intense heat source necessary for thermal decomposition and a process which utilizes heat generated by the partial oxidation of the garbage with air or oxygen supplied. In the former process, since an external heat is used, the problem lies in economy. In the latter process, since combustion gas gets mixed with generated gas, the calorific value of generated gas is decreased, disadvantageously making the usefulness of the generated gas inferior to that of the former process.

Another problem facing city governments is the disposal of toxic or hazardous materials, such as polychlorinated biphenyls (PCB's). These are toxic and hazardous compounds whose use is being withdrawn or prohibited because of the irreversible harm to the health and the environment. These materials must be managed and disposed of effectively. In addition to polychlorinated biphenyls, there are also organophosphorous, organonitrogen, and organometallic compounds as well as other materials, that exist in massive quantities and demand effective means of disposal. The majority of the toxic compounds are in a complex matrix format often combining organic and inorganic compounds or fractions, and in these cases, little or no disposal technology is available.

Various methods have been used for disposing of these toxic wastes, including thermal destruction, chemical detoxification, long-term encapsulation and specific landfill methods. With the exception of high temperature incineration, little success has been demonstrated for the safe disposal of highly toxic or extremely persistent waste, such as PCB's. The methods that have been tried have either not been able to handle anything but homogenous waste feed streams or they have only been able to handle relatively low concentrations of toxic compounds in the waste materials. Further, very few of the disposal methods tried to date have been able to develop to operate on a commercial scale.

Of the many methods tried for the disposal of toxic or hazardous wastes, thermal destruction has been the most promising. However, the toxic waste materials are usually very stable organic molecules, and they require long dwell times at high temperatures to effect thermal destruction. Some combustion or incineration systems can achieve the necessary conditions, but the facilities required are very large scale, and often the products of the combustion process present as much of a disposal problem as the original toxic wastes.

In the past, attempts have been made to use electric plasma arcs to destroy toxic wastes. An electric plasma arc system, being essentially pyrolytic, overcomes many of the deficiencies of an incineration or combustion process. The volume of gaseous products produced is much less. As a result, the equipment is substantially smaller in scale. Laboratory demonstrations have shown that a plasma arc is capable of atomizing and ionizing toxic organic compounds, and these atoms and ions usually recombine into simple products. While residual toxic materials are formed, these can be captured, so that no significant amount of toxic material is released to the environment.

Unfortunately, such pyrolytic destruction of waste materials is not suitable for a commercially viable system. Often, the gaseous products that are released into the environment can contribute to various forms of air pollution. In addition, the release of such gases causes concern among the various regulatory authorities in control of the destruction of such toxic materials. Furthermore, and importantly, such plasma arch, pyrolytic methods of waste destruction are extremely costly processes. The cost of the power needed to operate lasers, plasma arcs, or various other methods, cannot be justified on a large scale garbage disposal basis. Furthermore the by-products of the combustion process are not acquired for later sale or cost offset.

Various United States patents have attempted to address the issue of waste disposal by high temperature incineration process. U.S. Pat. No. 4,665,841, issued on May 19, 1987, describes a municipal trash destruction system in which hydraulic systems move the rubbish, garbage, and other municipal trash into a processor. The processor includes a trash processing zone, a fractionating system, a combustion zone, a heating exchange zone, a waste heat recovery system, and a precipitator for cleaning the emissions prior to release into the atmosphere. U.S. Pat. No. 4,644,877, issued on Feb. 24, 1987, describes the pyrolytic destruction of toxic and hazardous waste materials. The waste materials are fed into a plasma arc burner where they are atomized and ionized. These materials are then discharged into a reaction chamber to be cooled and recombined into product gas and particulate matter. The product gas is then extracted from the recombining products using a scrubber. The product gas may then be burned and utilized as a fuel. U.S. Pat. No. 4,695,448, issued on Sept. 22, 1987, describes the dissociating of toxic compounds by an electric arc (e.g. 12,000° F.) in an airtight chamber charged with oxygen. U.S. Pat. No. 4,759,300, issued on July 26, 1988, shows a method and apparatus for the pyrolysis of waste products. In this invention, the waste materials to be pyrolyzed are efficiently dehydrated prior to introduction into the pyrolysis retort using microwaves generated by a large microwave generator. After the waste material is dried, the initial ignition of the material is accomplished by using a high intensity laser beam. Laser ignition is continued until sufficient methane and other volatile gases are produced for burning in a burner unit to sustain the pyrolysis reaction. U.S. Pat. No. 4,667,609, issued on May 26, 1987, describes the destruction of soil contaminated with hydrocarbons by passing the material through a sealed, negatively pressurized, high temperature furnace. The temperature in one zone of this process is maintained at 2,900° F. so as to effectively destroy the contaminating hydrocarbons. U.S. Pat. No. 3,575,119 shows an apparatus for disintegrating and incinerating a concentrated slurry of solid organic material. Material passes through an arcuate tunnel having a plurality of arc electrodes spaced therealong. These electrodes cause the temperature to abruptly raise from about 2,000° F. to about 15,000° F. so as to dissolve the bonds between the carbon and the other atoms.

It is an object of the present invention to provide a waste disposal system that cleanly burns the waste material.

It is another object of the present invention to provide a waste disposal system that economically pays for itself by the recovery of the gaseous by-products of the combustion process.

It is a further object of the present invention to provide a waste disposal system in which the waste is burned in an oxygen-free environment.

It is still a further object of the present invention to provide a waste disposal system in which a liquid waste is preheated in an oxygen-free environment prior to gasification.

It is another object of the present invention to provide a preheating system which minimizes the cost of energy involved in the destructions of wastes.

These and other objects and advantages of the present invention will become apparent from a reading of the attached specification and appended claims.

SUMMARY OF THE INVENTION

The present invention is a process for the disposal of waste that comprises the steps of: (1) passing a liquid waste in heat exchange relationship with the surface of a sealed container so as to heat the liquid waste; (2) transmitting the heated liquid waste to a tank having a liquid waste contained therein; (3) delivering the heated liquid waste from the tank into the sealed container; and (4) heating the delivered liquid waste to a temperature sufficient to convert the liquid waste into a gas. Initially, the container is heated to a temperature of greater than 1500° F.

In this method, the step of passing the liquid waste to the surface of the sealed container comprises the step of pumping the liquid waste from the tank into a jacket extending around an exterior surface of the sealed container. The liquid waste is then circulated in the area between the jacket and the exterior of the sealed container so as to achieve a maximum heat exchange effect.

An inert gas is introduced into the interior of the tank so as to displace oxygen from within the tank. Specifically, this inert gas is an argon gas. The liquid waste is initially accumulated in a storage vessel. The liquid waste is then passed from the storage vessel into the interior of the tank. Any oxygen carried with the liquid waste is displaced by the introduction of the argon gas.

The step of delivering in this method comprises injecting the liquid waste into an interior of the sealed container. The liquid waste is injected by way of a diesel type injector and is sprayed so as to disperse the liquid waste throughout the interior of the sealed container. After the liquid waste is placed into the container, this liquid waste is heated to a temperature of greater than 2700° F.

The present invention is also an apparatus for the preheating of liquid waste that comprises a heated sealed container, a liquid waste tank, a jacket positioned around the sealed container so as to form a heat exchange region between an interior of the jacket and an exterior of the sealed container, and an injector for transmitting a heated liquid waste from the tank into the interior of the sealed container. The liquid waste tank communicates with the heat exchange region by way of suitable conduits.

An inert gas container is connected by suitable pipes and valves to the liquid waste tank. The inert gas container serves to pass an inert gas into the interior of the liquid waste tank for the purpose of displacing oxygen from the interior of the liquid waste tank. Specifically, this inert gas is argon. The liquid waste tank has a insulating layer formed around the exterior of the liquid waste tank so as to retain heat on the interior of the tank. In addition, an insulator surrounds the jacket so as to retain heat within the heat exchange region between the jacket and the exterior of the sealed container. A first conduit is interconnected between the interior of the liquid waste tank and the heat exchange region. Also, a second conduit is connected between the interior of the liquid waste tank and the heat exchange region. The first conduit delivers the liquid waste to the heat exchange region. The second conduit causes the heated liquid waste to be removed from this heat exchange region and transported back to the interior of the liquid waste tank.

A storage vessel is placed in valved communication with the liquid waste tank. The storage vessel contains the initial unheated liquid waste. A pipe communicates with the interior of the storage vessel and with the interior of the liquid waste container. A pump is interconnected between the storage vessel and the liquid waste tank so as to pass the liquid waste from the storage vessel into the liquid waste tank.

The injector is a diesel-type injector that communicates with the interior of the sealed container. This injector also communicates with the liquid waste tank.

The injector serves to atomize and disperse the heated liquid waste into the interior of the heated sealed container.

DETAILED DESCRIPTION OF THE INVENTION

Figure 1:
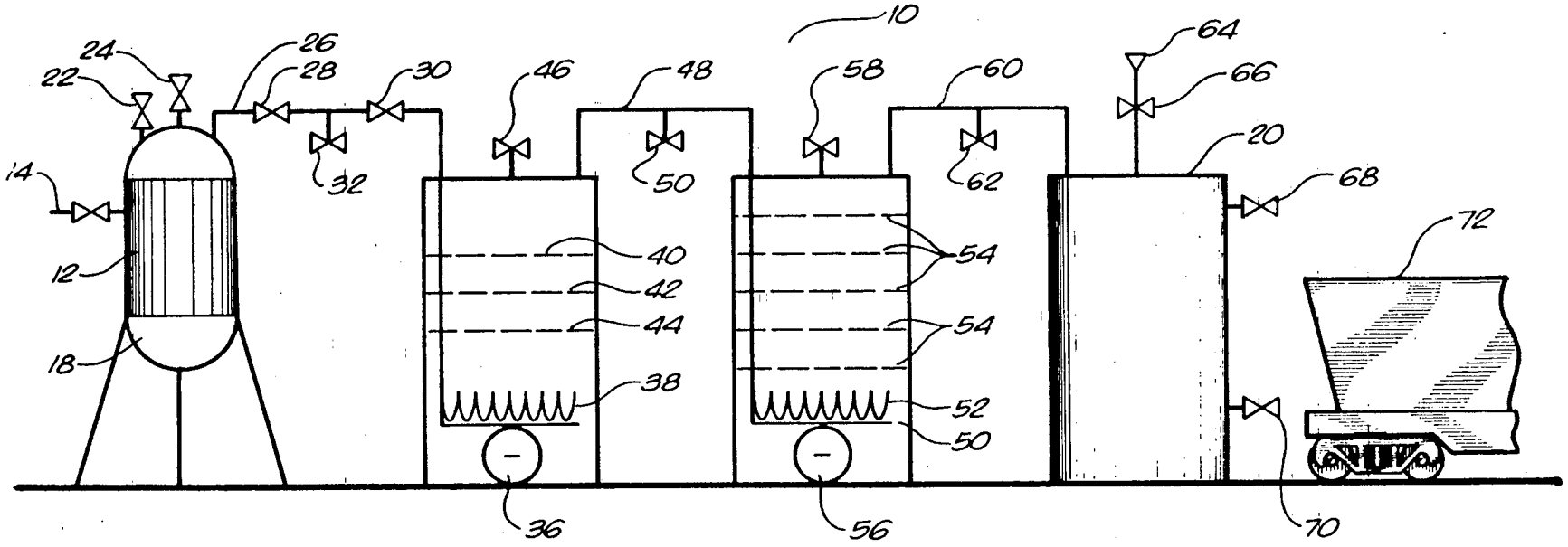
FIG. 1 is a schematic representation of the waste dispoal process and apparatus of the present invention.

Referring to FIG. 1, there is shown at 10 the waste disposal system in accordance with the preferred embodiment of the present invention. Specifically, the waste disposal system 10 includes sealed container 12, waste delivery channel 14, heater 18, and storage vessel 20.

Sealed container 12 is the apparatus that receives the waste. Sealed container 12 acts as the receptacle for the waste and for the gasifying of such waste. As described herein, the container 12 is "sealed" since container 12 is part of a closed system.

Sealed container 12 receives waste into its interior from the waste transport channel 14. In the preferred embodiment of the present invention, the waste that is delivered into the sealed container 12 is a liquid organic waste. Although this is specified in the preferred embodiment of the present invention, the present invention will achieve its same results with solid waste and with inorganic wastes. The present system can be used to dispose of garbage.

The heater 18 is an induction heater that has the capacity to cause the interior of sealed container 12 to exceed 2,700° F. in temperature. The induction heater 18 is shown, in FIG. 1, as positioned beneath the sealed container 12. However, in alternative embodiments of the present invention, the heater 18 may be positioned elsewhere. The only important requirement of the heater 18 of the present invention is that it generate a suitable temperature in an oxygen-free environment to gasify any waste delivered into the interior of container 12. A thermocouple 22 is connected to the container 12 so as to monitor the interior temperature of container 12. Thermocouple 22 is any of a variety of suitable pyromers that have the capacity to measure temperatures in excess of 2,700° F. Oxygen analyzer 24 is also connected to container 12 so as to measure the oxygen content of the atmosphere within container 12. Since it is important to the concept of the present invention that the destruction of the waste occur in an oxygen-free environment, the oxygen analyzer 24 is required so as to provide an indication of when the oxygen is effectively purged from the interior of container 12.

Line 26 communicates with the interior of sealed container 12 so as to cause the gaseous composition produced by the dissociation of the waste materials to pass from container 12. After the liquid waste has been effectively dissociated within container 12, the resulting complex composition of gases will pass outwardly from the container 12 through line 26. Temperature gage 28 and pressure gage 30 are positioned on line 26 to appropriately monitor the environmental conditions. A sampler 32 is also provided along line 26 so as to monitor and sample the gases passing through line 26. Since the composition of the liquid waste introduced into container 12 can have a wide variety of components, it is useful and necessary to monitor the complex composition of the gas as it passes through line 26. Line 26 extends from the container 12 to a water filter 38. Water filter 34 includes an access opening 36 that can be utilized so as to access the interior of water filter 38 and so as to remove any solid materials that are filtered from the gaseous composition. Initially, the gaseous composition is aerated by aerator 38. Aerator 38 causes a wide distribution of the gaseous composition to pass evenly through water filter 34. A plurality of stainless steel screens 40, 42, and 44 are positioned within water filter 38 such that the gaseous composition, as aerated, will flow upwardly through water filter 38 and pass through stainless steel screens 40, 42 and 44. Stainless steel screens 40, 42 and 44 serve to trap and remove sulphur and other particulate matter that may reside within the gaseous composition passing through water filter 34. Water filter 38 causes the carbon black, the carbon dioxide, and the carbon monoxide of the gaseous composition to mix with the water so as to become carbonic acid and carbon black in solution. It also serves to cool the gaseous composition passing therethrough. A vent 46 is provided so as to prevent any pressure build-up.

The water gaseous composition then passes from water filter 38 into pipe 48. Pipe 48 is a stainless steel pipe that has a sufficient capacity to allow the gaseous composition to pass freely therethrough. A sampler 50 is connected to pipe 48 so as to allow samples to be taken of the gaseous composition passing through pipe 48. Pipe 48 extends into sodium hydroxide filter 50. The gaseous composition from pipe 48 is aerated by aerator 52 such that the gaseous composition will pass from aerator 52 upwardly through sodium hydroxide filter 50. A plurality of stainless steel screens 54 are positioned across the sodium hydroxide filter 50 so as to remove sulphur and other particulate matter from the gaseous composition. As the gaseous composition passes through the sodium hydroxide solution within the sodium hydroxide filter 50, the chlorine in the gaseous composition will be converted into a salt. The salt, in solid form, may be removed, as needed, through access opening 56 in sodium hydroxide filter 50. A vent 58 is provided on sodium hydroxide filter 50 so as to prevent problems from pressure build-up.

After the gaseous composition has passed through the sodium hydroxide solution within the sodium hydroxide filter 50, the gaseous composition will pass into pipe 60. Pipe 60 is a stainless steel pipe that extends from the sodium hydroxide filter 50 to storage tank 20. Storage tank 20 receives the gaseous composition, as filtered, from pipe 60. A sampler 62 is provided on pipe 60 so as to allow the operator of the system to take periodic samples of the gaseous composition passing through pipe 60. Storage tank 20 includes a flare 64 or a secondary source for heat. Storage tank 20 also includes a pressure release valve 66 so as to prevent unnecessary pressure build-up. A sampler 68 is provided on the storage tank 20 so as to allow the operator of the system to take periodic samples of the gaseous composition contained within storage tank 20.

Storage tank 20 includes the gaseous composition having many compounds. In their combined form, these gases are relatively valueless. However, a molecular sieve 70 is connected to the storage tank 20 so as to allow the gases to be separated and removed from storage tank 20. The molecular sieve 70 allows the gases to be separated into their individual components. For example, molecular sieve 70 may be of a type that only allows ethylene to pass therethrough and from storage tank 20. As can be seen in FIG. 1, such a selected gas will then pass into a tanker truck 72 so as to be shipped and sold to a designated location. Tanker truck 72 can be utilized for a single gas or can be a multiple container truck for receiving an assortment of separated gases. The ability to produce and sell the gases resulting from the process of the present invention allows the process to be economical. Ultimately, the value of the gases produced from the initial waste should exceed the cost of operating the system of the present invention.

It has been found that it is important to the efficiency and effectiveness of the waste disposal system, described hereinbefore, to preheat the liquid waste prior to its introduction into sealed container 12. The preheating of the liquid waste offers several advantages. First, the preheating of the liquid waste enhances the energy efficiency of the system since the amount of heat required in order to gasify the liquid waste is much less once the liquid waste is preheated. Secondly, the preheating avoids much of the shock effect on the material used for the sealed container 12. Thirdly, the preheating aids in the dispersion and distribution of the liquid waste throughout the interior of the sealed container.

Figure 2:
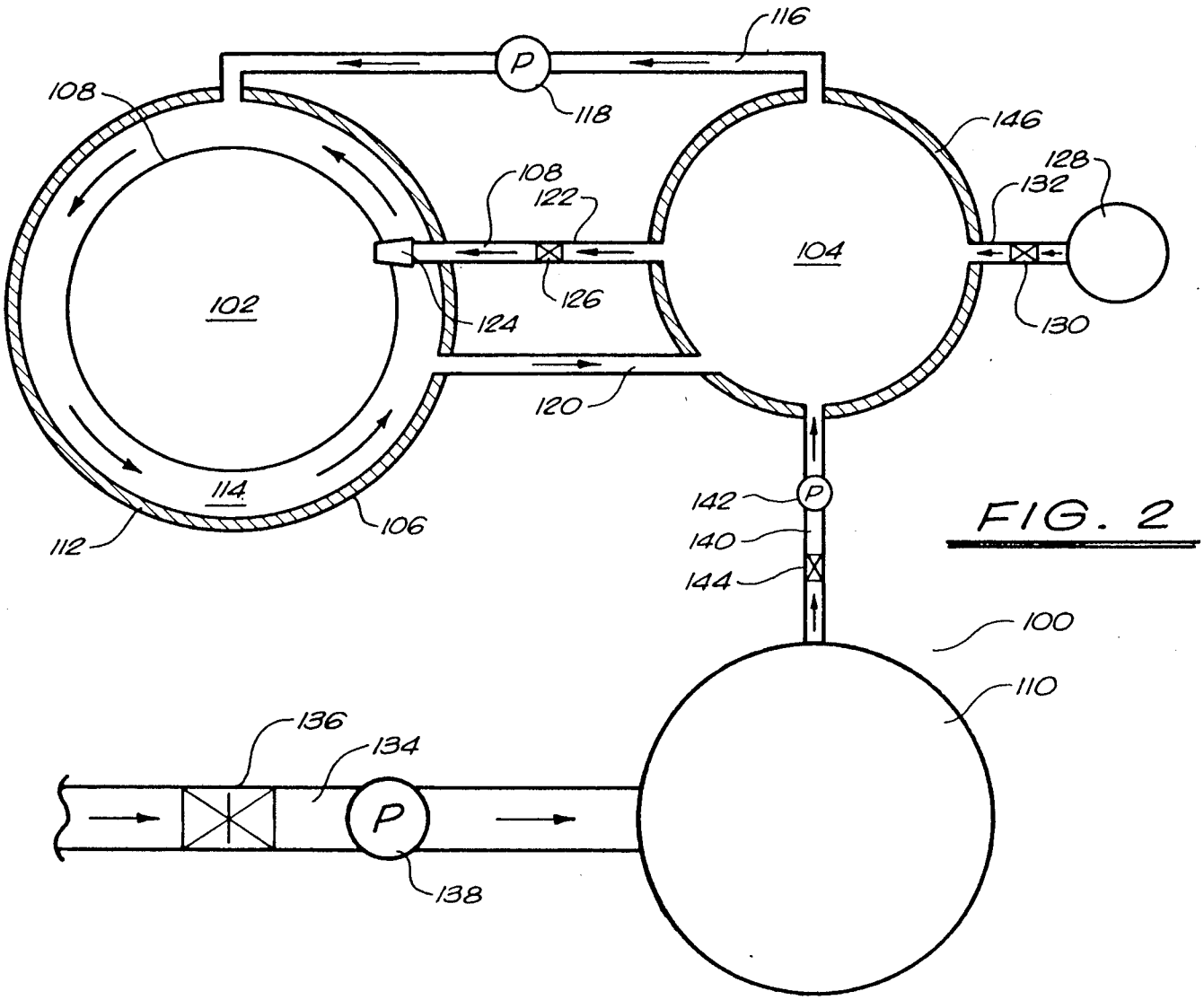
FIG. 2 is a diagrammatic representation of the preheating system for the waste disposal process of the present invention.

FIG. 2 illustrates a system 100 which can be used for the preheating of the liquid waste. System 100 comprises a heated sealed container 102, a liquid waste tank 104, a jacket 106, and an injector 108. The heated sealed container 102 is heated in a manner described in conjunction with the container 12 of FIG. 1. Essentially the heated sealed container 102 should have the capacity to be elevated to a temperature of greater than 1500° F. Typically, the exterior wall 108 will also be heated to such a high temperature.

The liquid waste tank 104 is a stainless steel tank. Tank 104 is a part of a generally sealed system. Tank 104 receives the liquid waste as transmitted by storage vessel 110.

The jacket 106 extends around the exterior 108 of the sealed container 102. Jacket 106 includes an insulating material 112 that is formed on the exterior surface of the jacket 106. Insulating material 112 is a suitable insulator that causes heat on the interior of the jacket 106 to be retained therewithin. As such, the jacket 106 defines a heat exchange region 114 which is between the exterior surface 108 of sealed container 102 and the interior of jacket 106.

A conduit 116 communicates between the interior of tank 104 and the heat exchange region 114. Conduit 116 is a pipe that allows the liquid waste on the interior of tank 104 to flow (in the direction shown by the arrows) toward the heat exchange region 114. A suitable pump 118 is provided so as to facilitate the transport of the liquid waste from the tank 104 to the heat exchange region 114. Once in the heat exchange region 114, the liquid waste will circulate in the manner illustrated by the arrows shown in the heat exchange region 114. As the liquid waste circulates around the exterior 108 of sealed container 102, a heat exchange effect will occur with the liquid waste. Essentially, the liquid waste will begin to elevate in temperature based upon the contact of the liquid waste with the sealed container 102. The liquid waste will eventually flow out of the heat exchange region 114 through conduit 120 and into the interior of tank 104. In this manner, the process causes the temperature of the liquid waste from tank 104 to suitably increase. As the process continues, the temperature of the liquid waste in tank 104 will increase to approximately 1000° F. Once a suitable temperature is achieved within tank 104, the liquid waste will pass through injector 108 in the direction indicated by the arrows therein. Injector 108 comprises a conduit 122 that communicates with the interior of tank 104. The liquid waste will flow out of the tank 104, through conduit 122, to the injector nozzle 124. Injector nozzle 124 is similar to a diesel injector which cause the liquid waste to be generally atomized and dispersed throughout the interior of sealed container 102. This dispersal process tends to spray the liquid waste throughout the interior of sealed container 102 so as to assist the pyrolysis effect. A suitable valve 126 is provided on conduit 122 so as to properly control the delivery of the liquid waste from tank 104 to sealed container 102.

As stated previously, it is important to the concept of the present invention that the sealed container 102 have an oxygen-free environment. As such, an inert gas storage tank 128 is provided. Inert gas storage tank 128 contains an inert gas, preferably, argon. A valve 130 controls the flow of the argon gas from the tank 128 to the tank 104. In the process of the present invention, when the liquid waste is delivered from the storage vessel 110 into the tank 104, any oxygen is suitably displaced by the delivery of the inert gas from tank 128 into the interior of tank 104. As such, the liquid waste resides in an oxygen-free environment. The argon gas will pass in the manner illustrated by the arrows within conduit 132 extending from tank 128 to tank 104. After experimentation, it was found that argon gas is the ideal inert gas to be used. It was found that the use of other inert gases, such as nitrogen, can have a deteriorating effect upon the material used for the tank 104 and the sealed container 102. Argon gas appears to solve this problem.

Initially, in this process illustrated in FIG. 2, a liquid waste is delivered through pipeline 134, and through valve 136, to the interior of storage vessel 110. A pump 138 is provided so as to suitably deliver the liquid waste through the pipeline 134. The valve 136 may be actuated, as needed, to deliver a suitable supply of the liquid waste to the tank 110. The liquid waste that is delivered through pipeline 134 to tank 110 will, typically, be at an ambient temperature. Once the liquid waste resides in the storage vessel 110, it may be delivered to the tank 104 through pipe 140. Pipe 140 includes a pump 142 that will draw the liquid waste through the pipe 140, from the storage vessel 110, and pass the liquid waste into the interior of tank 104. A valve 144 is provided so as to selectively control the flow of the liquid waste. The pipe 140 passes from the storage vessel 110 and opens to the interior of tank 104. An insulating layer 146 surrounds the tank 104 so as to retain the heat of the heated liquid waste therewithin.

After the process of FIG. 2 has been carried out, the heated liquid waste is suited for injection into the sealed container 102. At this stage, the process of FIG. 1 continues onward.

Heat is applied to the interior of container 12 by induction heating. Specifically, and ideally, the interior of container 12 will be heated to a temperature of between 2700° and 3500° F. The temperature in this range will allow all hydrocarbons to become dissociated and be converted into gaseous composition. Although higher temperatures than this may be possible, it is believed that higher temperature would be additionally costly and have adverse consequences to the economic benefit of the process of the present invention. Since the waste is being gasified in an oxygen-free environment, the oxygen is not available to cause pollution. By the process of the present invention, carbon dioxide, carbon monoxide, chlorine and sulphur dioxides are not released. Inert gases will not combine with dissociated molecules so as to form pollutants. Since the container is operated at superhigh temperatures, there is no possibility of clinkers being produced, and deterious material, such as polychlorinated biphenyl, which is considered difficult to decompose, is completely decomposed into a harmless gas. Nitrogen oxide is not produced because of the operation of the system in an oxygen-free environment. In the system of the present invention, there is no oxygen existing in the system, except for the brought in with the waste charged into the container. As a result, little oxygen exists within the container and, if it exists, it is very low in concentration. Since oxygen reacts with hydrocarbon and hydrogen sooner than with nitrogen, no nitrogen monoxide is allowed to be produced. In addition, since the effects of nitrogen on the molecule of the waste becomes smaller in proportion to an increase in temperature, no nitrogen oxide is produced.

When the gaseous composition has been produced by the superhigh temperatures of container 12, the gas passes through water filter 34 so as to remove a portion of the carbon content of the gas. The gaseous composition is then passed from the water filter 34 through a sodium hydroxide filter 50 so as to remove a portion of the chlorine component of the gas. Ideally, the resultant solids produced by these filtering processes can be removed through the access openings 36 and 56 of the respective filters.

The remaining gaseous composition then passes into storage vessel 20. Storage vessel 20 has equipment with appropriate molecular sieves so as to allow the removal of the specific gases of the gaseous composition.

In experiments conducted with the process of the present invention, readings were taken of the resultant gas composition that would pass into the storage vessel 20 of the process of the present invention. Table I, hereinbelow, shows a breakdown of the gas composition. Of particular note, no oxygen was detected as part of the composition. Importantly, very valuable gases, such as methane, propane, and ethylene, were produced by the burning of a liquid organic waste.

TABLE I

| | |
|---|---|
| HYDROGEN | 34.60 Mol. % |
| CARBON DIOXIDE | 6.22 Mol. % |
| ETHYLENE | 8.52 Mol. % |
| ETHANE | 2.35 Mol. % |
| ACETYLENE | 0.15 Mol. % |
| OXYGEN | NONE DETECTED |
| NITROGEN | 0.70 Mol. % |
| METHANE | 25.53 Mol. % |
| CARBON MONOXIDE | 6.22 Mol. % |
| PROPANE PLUS | 15.71 Mol. % |

Another analysis was conducted of the burning of garbage introduced into the container. Table II shows the specific breakdown of the resultant gases that would be found in the storage vessel 20. In Table II, it can be seen that valuable gases, such as ethylene, methane and propane, were produced from the process of the present invention.

TABLE II

| | |
|---|---|
| HYDROGEN | 30.291 Mol. % |
| CARBON DIOXIDE | 14.187 Mol. % |

TABLE II-continued

| | |
|---|---|
| ETHYLENE | 8.064 Mol. % |
| ETHANE | 0.913 Mol. % |
| ACETYLENE | 0.429 Mol. % |
| HYDROGEN SULFIDE | NONE DETECTED |
| OXYGEN | NONE DETECTED |
| NITROGEN | 0.477 Mol. % |
| METHANE | 10.802 Mol. % |
| CARBON MONOXIDE | 26.254 Mol. % |
| PROPANE PLUS | 8.583 Mol. % |

It can be seen from the present invention that the present invention achieves a pollution-free destruction of waste. Since the destruction of the waste occurs in an oxygen-free environment, there is no pollution to be released into the atmosphere. Furthermore, the production of valuable gases from the process of the present invention allows such gases to be sold separate and apart from the destruction process itself. The value of such gases, at least, economically offsets the cost of the operation of the waste destruction system of the present invention. In prior art systems, the heat necessary to gasify the waste would be too costly for economic consideration. In the present invention, this cost is greatly offset by the value of the produced gaseous by-products of the process.

The foregoing disclosure and description of the invention is illustrative and explanatory thereof, and various changes in the method steps, as well as in the details of the illustrated apparatus, may be made within the scope of the appended claims without departing from the true spirit of the invention. The present invention should be limited by the following claims and their legal equivalents.

I claim:

1. A process for the disposal of waste comprising:

passing a liquid waste in heat exchange relationship with the surface of a sealed container so as to heat said liquid waste;

transmitting the heated liquid waste to a tank having said liquid waste contained therein;

delivering said liquid waste from said tank into said sealed container; and heating the delivered liquid waste to a temperature sufficient to convert said liquid waste into a gas.

2. The process of claim 1, said step of passing a liquid waste comprising:

pumping said liquid waste from said tank into a jacket extending around an exterior surface of said sealed container.

3. The process of claim 1, further comprising the step of:

introducing an inert gas into the interior of said tank so as to displace oxygen from within said tank.

4. The process of claim 3, said inert gas comprising argon gas.

5. The process of claim 2, further comprising the steps of:

accumulating said liquid waste in a storage vessel; and passing said liquid waste from said storage vessel into an interior of said tank.

6. The process of claim 1, said step of heating comprising:

heating said sealed container to a temperature of greater than 2700° F.

7. The process of claim 1, said step of delivering comprising:

injecting said liquid waste into an interior of said sealed container.

8. The process of claim 1, said step of passing further comprising:

circulating said liquid waste around the exterior surface of said sealed container so as to heat said liquid waste.

9. The process of claim 7, said step of injecting comprising:

atomizing said heated liquid waste; and dispersing said atomized liquid waste throughout said interior of said sealed container.

10. An apparatus for the preheating of liquid waste comprising:

a heated sealed container;

a liquid waste tank;

a jacket positioned around said heated sealed container so as to form a heat exchange region between an interior of said jacket and an exterior of said heated sealed container, said liquid waste tank communicating with said heat exchange region; and injection means for transmitting a heated liquid waste from said tank into an interior of said heated sealed container.

11. The apparatus of claim 10, further comprising:

an inert gas container connected to said liquid waste tank, said inert gas container for passing an inert gas into an interior of said liquid waste tank.

12. The apparatus of claim 11, said inert gas comprising argon, said argon for displacing oxygen from said interior of said liquid waste tank.

13. The apparatus of claim 10, said liquid waste tank having an insulating layer formed around an exterior of said liquid waste tank.

14. The apparatus of claim 10, further comprising:

a first conduit interconnected between said interior of said liquid waste tank and said heat exchange region, said first conduit for delivering said liquid waste to said heat exchange; and a second conduit interconnected between said interior of said liquid waste tank and said heat exchange region, said second conduit for passing a heated liquid waste from said heat exchange region to said interior of said liquid waste tank.

15. The apparatus of claim 10, said jacket further comprising:

an insulator surrounding said jacket for retaining heat within said heat exchange region.

16. The apparatus of claim 10, further comprising:

a storage vessel in valved relationship with said liquid waste tank said storage vessel containing said liquid waste.

17. The apparatus of claim 16, said storage vessel further comprising:

a pipe communicating with the interior of said storage vessel; and a pump interconnected between said storage vessel and said liquid waste tank, said pump for passing said liquid waste from said storage vessel to said liquid waste tank.

18. The apparatus of claim 10, said liquid waste tank and said jacket comprised of a stainless steel material.

19. The apparatus of claim 10, said injection means comprising an injector communicating with said interior of said sealed container, said injector communicating with said liquid waste tank, said injector for atomizing said heated liquid waste into said sealed container.

* * * * *